US007948392B2

(12) United States Patent
Smith et al.

(10) Patent No.: US 7,948,392 B2
(45) Date of Patent: May 24, 2011

(54) DISPLAY MONITORING SYSTEMS

(75) Inventors: Euan Smith, Cambridgeshire (GB); Jeremy Burroughes, Cambridge (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 322 days.

(21) Appl. No.: 12/090,058

(22) PCT Filed: Oct. 6, 2006

(86) PCT No.: PCT/GB2006/003729

§ 371 (c)(1),
(2), (4) Date: Jun. 12, 2008

(87) PCT Pub. No.: WO2007/042774

PCT Pub. Date: Apr. 19, 2007

(65) Prior Publication Data

US 2008/0246606 A1 Oct. 9, 2008

(30) Foreign Application Priority Data

Oct. 14, 2005 (GB) ..... 0520924.2

(51) Int. Cl.
*G08B 23/00* (2006.01)

(52) U.S. Cl. ..... 340/693.6; 340/815.5; 455/550.1

(58) Field of Classification Search ..... 340/693.5, 340/644, 815.4, 815.41, 815.45, 815.5, 815.55, 340/815.73, 693.6, 815.49; 345/82, 170, 345/176, 102; 250/214 R; 455/550.1, 466
See application file for complete search history.

(56) References Cited

U.S. PATENT DOCUMENTS

| | | | | |
|---|---|---|---|---|
| 4,539,507 | A | 9/1985 | VanSlyke et al. | |
| 5,793,344 | A | 8/1998 | Koyama et al. | |
| 6,414,661 | B1 | 7/2002 | Shen et al. | |
| 7,288,753 | B2 * | 10/2007 | Cok | 250/214 R |
| 7,573,463 | B2 * | 8/2009 | Liess | 345/170 |
| 2004/0008208 | A1 | 1/2004 | Dresevic et al. | |
| 2004/0169588 | A1 * | 9/2004 | Imamura et al. | 340/644 |
| 2005/0190136 | A1 | 9/2005 | Edelbrock | |
| 2006/0279558 | A1 * | 12/2006 | Van Delden et al. | 345/176 |

FOREIGN PATENT DOCUMENTS

| | | |
|---|---|---|
| GB | 2 378 344 | 2/2003 |
| WO | WO-90/13148 | 11/1990 |
| WO | WO-95/06400 | 3/1995 |
| WO | WO-99/21935 | 5/1999 |
| WO | WO-99/48160 A1 | 9/1999 |
| WO | WO-02/067343 | 8/2002 |
| WO | WO-2005/069259 | 7/2005 |
| WO | WO-2005/104075 | 11/2005 |

OTHER PUBLICATIONS

International Search Report for PCT/GB2006/003729 dated Mar. 8, 2007.

* cited by examiner

*Primary Examiner* — Van T. Trieu
(74) *Attorney, Agent, or Firm* — Marshall, Gerstein & Borun LLP

(57) ABSTRACT

A consumer electronic device (CED) having a display and including at least one light sensor for recalibrating the display at intervals, wherein the display and the at least one light sensor are mounted within different parts of a unitary housing such that when the CED is not in use the light sensor is able to monitor light from the display. Preferably, the different parts of the unitary housing comprise two hinged parts, one mounting the display, the other at least a light sensing portion of the sensor.

8 Claims, 3 Drawing Sheets

DISPLAY MONITORING SYSTEMS

BACKGROUND OF THE INVENTION

1. Field of the Invention

This invention is generally concerned with systems and methods for monitoring displays, in particular OLED (Organic Light Emitting Diode) displays.

2. Related Technology

One problem with displays in general, and OLEDs in particular, is unequal aging of pixels of the display. Thus "screen burn" was a feature of cathode ray tube-based monitors of early computer systems. In computers the use of screen savers has reduced the effects of screen burn but, depending upon the application, such techniques are not always applicable. Moreover a particular problem arises in colour OLED displays where pixels of different colors may often age at different rates. In this specification the general term "pixels" is also used to refer to different colored sub-pixels of a colour color display.

One technique for reducing the unevenness in an OLED display is described in WO 2005/069259. This describes an arrangement in which a portable device is monitored by a light sensor in a recharging cradle whilst the device is mounted on the cradle. However this has the disadvantage of requiring a bulky charger which is at least the size of the display. An additional disadvantage is that a separate item of equipment, dedicated to the monitored device, is required.

An alternative approach is described in the applicant's UK Patent Application No. 0408960.3, filed 22 Apr. 2004. This document describes arrangements which incorporate photo sensors into an OLED display, in particular sensing light wave guided in the display substrate. However this has the disadvantage of increasing the manufacturing cost of the display.

Further background prior art can be found in U.S. Pat. No. 6,414,661 and U.S. Pat. No. 5,793,344.

GENERAL DESCRIPTION

According to the present invention there is therefore provided a consumer electronic device (CED) having a display and including at least one light sensor for recalibrating said display at intervals, wherein said display and said at least one light sensor are mounted within different parts of a unitary housing such that when said CED is not in use said light sensor is able to monitor light from said display.

Preferably the different parts of the unitary housing comprise a first and second parts hingeably connected to one another, the display being mounted in one of the parts, the sensor, or at least a light sensing portion of the sensor, being mounted in the other part. Thus in embodiments the sensor or sensors and display are spaced apart from one another. The hingeably connected parts of the housing preferably make up a clamshell-type housing one part of which holds the display, the other part a keyboard for the device. The light sensing portion of the sensor may then be integrated with the keyboard so that the sensor is able to monitor light from the display when the clamshell is closed.

One or more light sensors may be disposed between keys of the keyboard and/or a key of the keyboard may be translucent when light from the display can pass through the key top to a light sensor underneath. The light sensor may, in embodiments, comprise a light sensing device coupled to a light guide such as a fiber optic or a waveguide integrally formed as part of the housing. This facilitates convenient positioning of the light sensing device in compact consumer equipment where space is frequently at a premium. Some consumer devices, such as some mobile phones, include light emitting diode-based keyboard illumination and, when the device is not in use, one or more of these LEDs may be used as a light sensor.

In some preferred embodiments a plurality of light sensors is employed for sensing different parts and/or colors of the display. The outputs from these sensors may be combined or processed separately.

In embodiments a system is provided to use the plurality of light sensors to sense a plurality of illuminated pixels (or sub-pixels) of the display simultaneously. Such a system may comprise data processor to multiply a vector having values defined by signals from the plurality of light sensors by a calibration matrix to determine light output data for the plurality of illuminated pixels. In this way, although a particular sensor may detect light from more than one illuminated pixel, the signals from the sensors may be processed to substantially decouple the light output signals for each separate, illuminated pixel.

Thus in a further aspect the invention provides a monitoring system for monitoring a consumer electronic device having a display including a plurality of pixels, for recalibrating said display at intervals, the monitoring system comprising an input to receive signals from a plurality of light sensors monitoring light outputs of a plurality of said pixels simultaneously, a processing system coupled to said input to process said signals from said plurality of light sensors and determine light output data for said plurality of simultaneously monitored display pixels, and an output coupled to said processing system, to output said light output data.

The monitoring system may be employed together with a display driver configured to use the light output data to compensate for age-related or other changes in pixel (which includes sub-pixel) characteristics.

In preferred embodiments a consumer electronic device (CED) as described above or including such a monitoring system therefore further comprises an OLED display driver for driving an OLED display of the device, and an OLED display control system coupled to the light sensor or monitoring system, and to the OLED display driver, for controlling driving of the OLED display responsive to a signal or signals, optionally processed as described above, from the one or more light sensors. Preferably a system is further provided to control illumination of pixels of the display when the CED is not in use, for example driving the display to illuminate the pixels sequentially in turn. Where more than one pixel is illuminated simultaneously the display may be logically partitioned into two or more sub-fields (spatially partitioned and/or partitioned by color) pixels being driven in turn in each of the sub-fields simultaneously.

Preferably the display comprises an OLED display, which here includes OLED displays using one or more of the following non-limiting classes of material: polymer materials, small molecule materials, dendrimer materials, and organic and organo-metallic materials in general. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

BRIEF DESCRIPTION OF THE DRAWINGS

These and other aspects of the invention will now be further described, by way of example only, with reference to the accompanying figures in which.

DETAILED DESCRIPTION

Figure 1A:
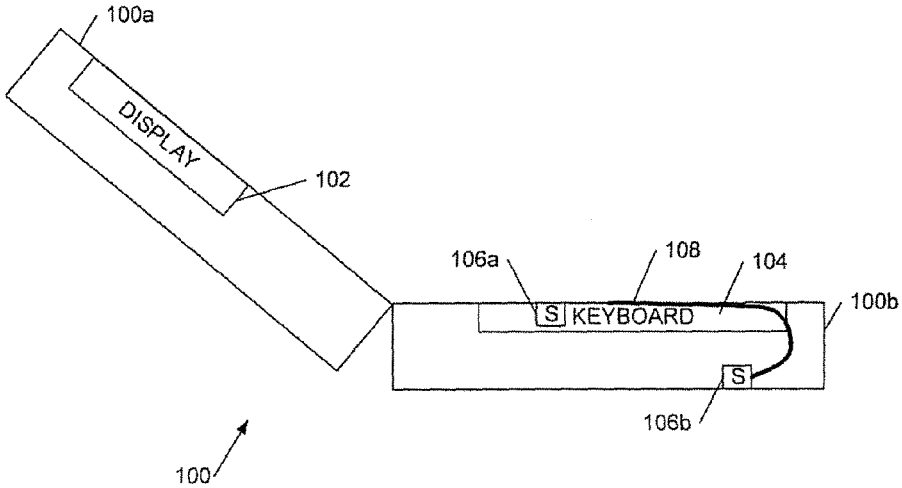
FIGS. 1*a* and 1*b* show examples of a consumer electronic device embodying aspects of the present invention.

FIG. 1*a* shows an example of a clamshell-type mobile communications device 100 comprising hinged parts 100*a, b* one containing a display 102, the other a keyboard 104. Two alternative sensor positions 106*a, b* are indicated, sensor 106*b* having a fiber optic light guide 108 from the keyboard portion of the device. It can be seen that when the clamshell is closed light from display 102 can be detected by a sensor 106, for example a photo diode.

Figure 1B:
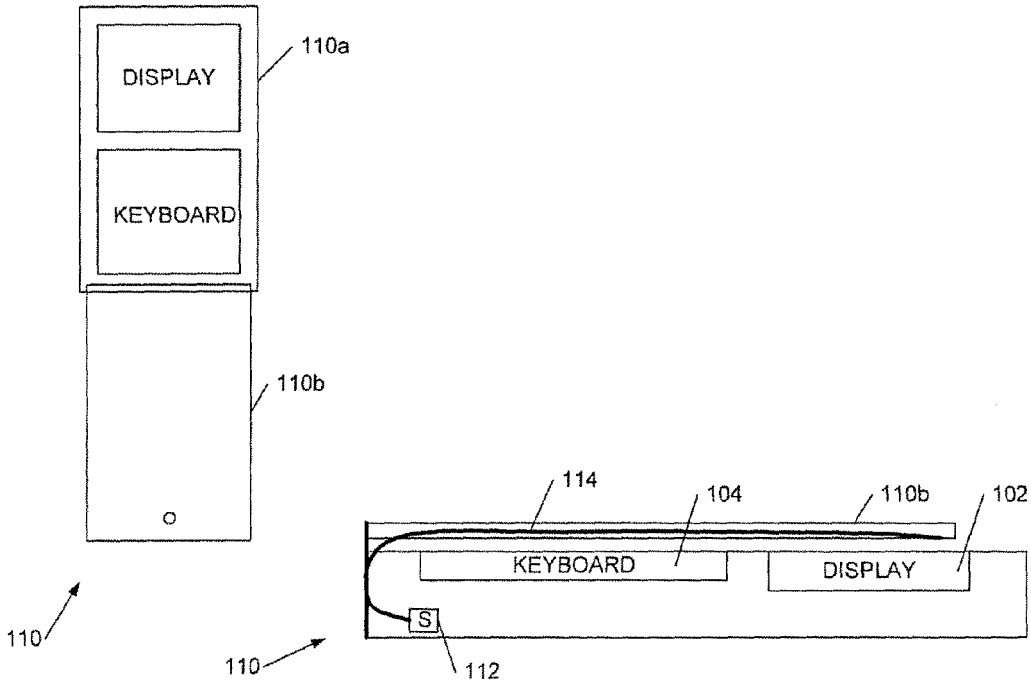

FIG. 1*b* shows a second example of a mobile communications device 110 in which both the keyboard and display are mounted in a first part 110*a* of the device, a second, flip-down part 110*b* providing a microphone or sound deflector. In the example of FIG. 1*b* a sensor 112 is mounted in part 110*a* and a fiber optic connection 114 is provided to part 110*b* for sensing light from the display when the device is not in use.

Figure 2A:
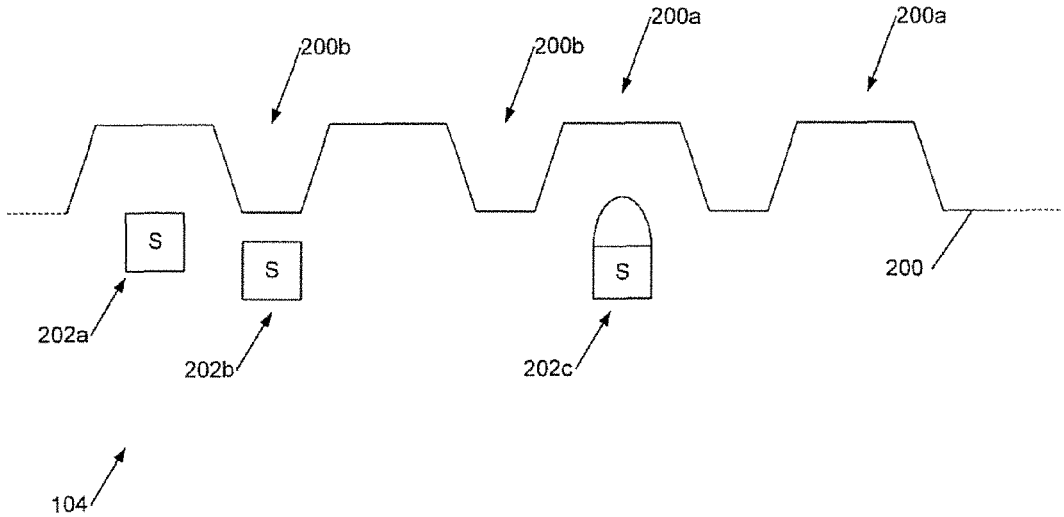
FIGS. 2*a* to 2*c* show example under-keyboard sensor positions.

FIG. 2*a* shows a vertical cross-section through a keyboard 104 showing, in particular, a rubber or plastic key cover 200 with keys at positions 200*a* and spaces between keys at position 200*b*. The figure illustrates some alternative positions 202*a, b, c* for an under-key sensor S. The sensor at position 202*c* comprises a light emitting diode for illuminating the keypad, which is also operable as a sensor. Single or multiple sensors may be employed; a sensor may be panchromatic or color-specific—in particular separate sensors with red, green, and blue filters may be employed for monitoring red, green and blue pixels of the display.

Figure 2B:
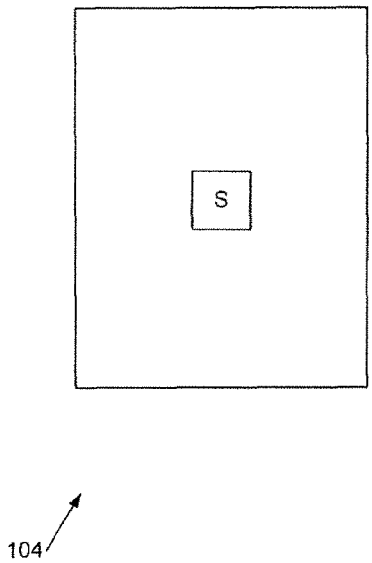
Figure 2C:
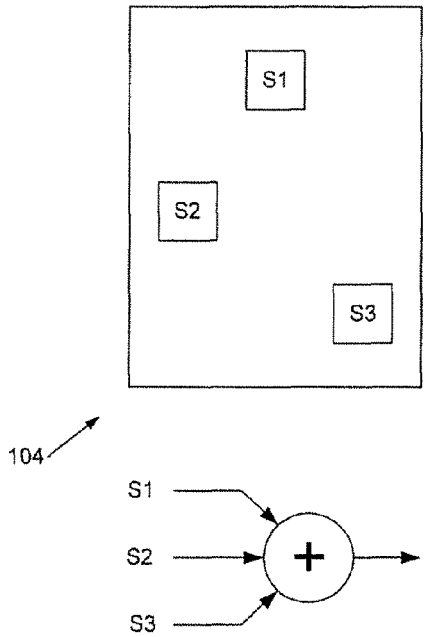

FIG. 2*b* shows an example of a single sensor positioned approximately in the middle of the keyboard so as to be opposite the display 102 when the clamshell of FIG. 1*a* is closed. FIG. 2*c* illustrates the use of multiple sensors at different positions for sensing different parts of the display. The signals from these sensors may be processed separately or combined as illustrated. Using multiple sensors has the advantage of a rapid evaluation of the display.

Broadly speaking, in operation, the display is driven to illuminate one pixel at a time and the light output of the pixel is measured by one or more of the sensors. The light output may be compared with an initial value determined, for example, either by a first use calibration or at manufacture or against a predetermined reference value (where display characteristics are substantially predictable).

Figure 3:
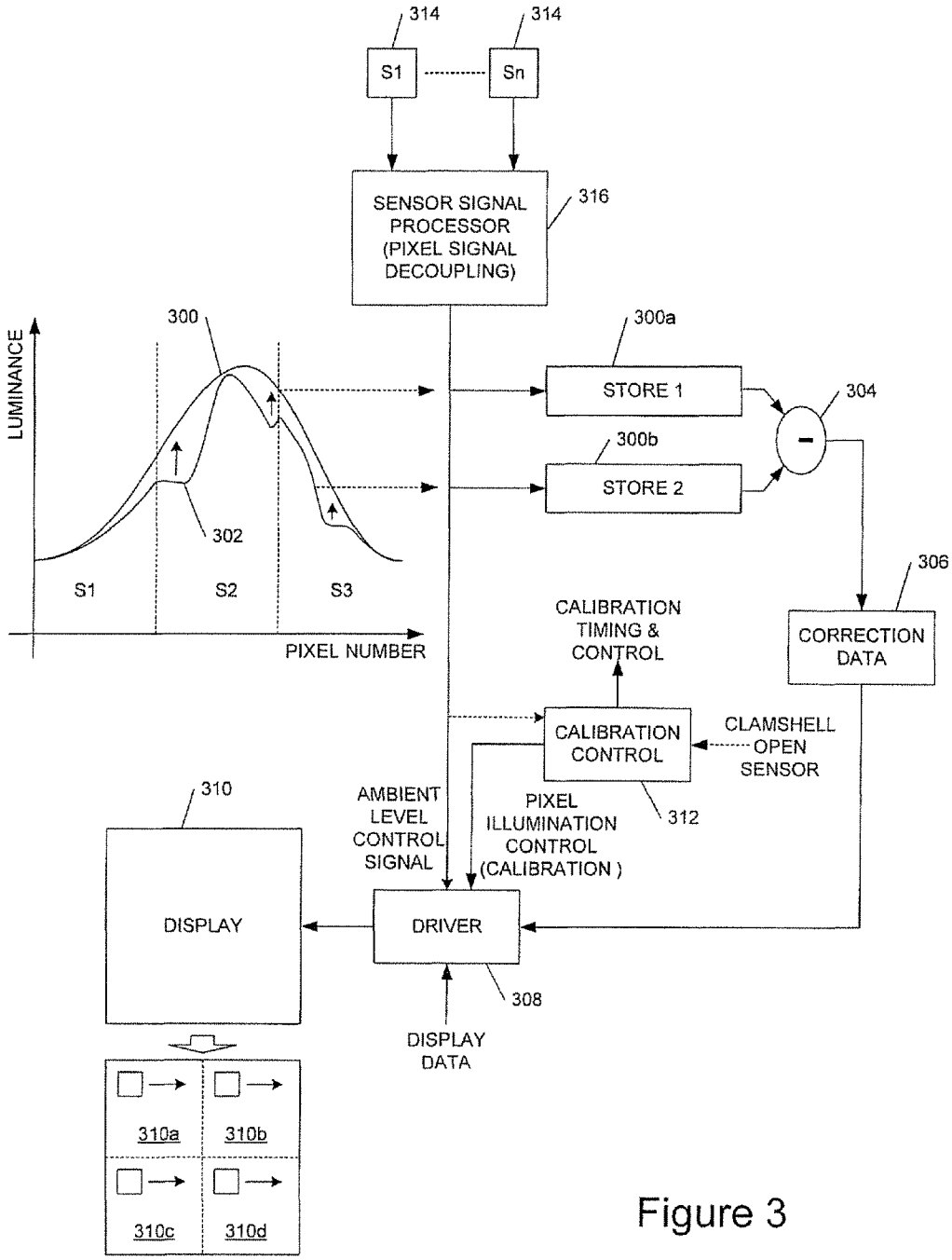
FIG. 3 shows a block diagram of an embodiment of a system according to the invention.

Referring now to FIG. 3, this shows, on the left hand side, example curves of luminescent pixel number (where the pixels of the display are numbered sequentially), as illustrated different portions of the curve being derived from the signals of different sensors S1, S2 and S3. An initial curve 300 and a later, measured curve 302 are compared in order to determine a correction value of each pixel to compensate for age-related (or other) display characteristic variations.

Referring next to the block diagram in FIG. 3, data for the curve 300 are stored in a first, non-volatile store 300*a* and captured data for the curve 302 are stored in a second store 302*a*. The contents of these two stores may be subtracted 304 for each pixel to provide correction data 306 which are used by an OLED display driver 308 to correct display data defining pixel luminescence/color values for a display 310. A calibration control system 312 provides calibration, timing and control signals for controlling data capture and the generation of correction data 306, as well as providing pixel illumination control signals to a driver 308 for driving the display to illuminate each pixel in turn. A calibration control system 312 has an input to allow the system to determine when the consumer electronic device is not in use, for example using an existing "clamshell open" sensor, or using overall light level sensed by one or more of the sensors. The sensed light level may also be employed, when the device is in use, to control the display brightness in accordance with ambient light level, to decrease the overall display brightness in reduced brightness ambient conditions, and hence save power.

In some preferred embodiments a plurality of sensors 314 is employed to monitor a plurality of portions of the display simultaneously. Thus the display must be logically partitioned into a number of sub-fields 310*a-d* and pixels scanned across each of these sub-fields simultaneously as illustrated. The sensors may be positioned and/or baffles may be employed so that each sensor receives light mainly from only one of the display sub-fields, but preferably a sensor signal processor 316 is employed for pixel signal decoupling as described further below.

Say, for the sake of example, the light output of three pixels A, B, C is to be monitored simultaneously by three detectors having respective outputs α, β, γ the relationship between the detected light and the pixel light outputs is given by Equation 1 below:

$$\begin{bmatrix} \alpha \\ \beta \\ \gamma \end{bmatrix} = \begin{bmatrix} \alpha_A & \alpha_B & \alpha_C \\ \beta_A & \beta_B & \beta_C \\ \gamma_A & \gamma_B & \gamma_C \end{bmatrix} \begin{bmatrix} A \\ B \\ C \end{bmatrix} \tag{1}$$

the pixel values can then be determined using Equation 2 below:

$$\begin{bmatrix} A \\ B \\ C \end{bmatrix} = M^{-1} \begin{bmatrix} \alpha \\ \beta \\ \gamma \end{bmatrix} \tag{2}$$

where $$M = \begin{bmatrix} \alpha_A & \alpha_B & \alpha_C \\ \beta_A & \beta_B & \beta_C \\ \gamma_A & \gamma_B & \gamma_C \end{bmatrix}$$

In order to simplify the matrix inversion it is preferable that the matrix is well-conditioned and by adopting a sub-field scanning system of the type shown in FIG. 3, with corresponding pixel scanning being applied to each sub-field and one sensor (detector) per sub-field, a close-to diagonal matrix can be obtained. In embodiments the inverse matrix may be determined in advance. The operation of Equation 2 may be performed by software, dedicated hardware, or a combination of the two.

The use of one or more sensors, which may or may not employ the above described mathematical technique for decoupling the sensed signals from different pixels, in embodiments enables fast and/or multi-color recalibration as well as helping to overcome problems with dirt on the sensors and the like. However in relation to the latter problem it will be appreciated that the pixel correction data comprises data for correcting pixel values relative one another. Nonetheless the use of more than one detector can help to ensure that overall reduced sensed light output values are less likely to result in overdriving of the display.

It will be appreciated that calibration takes place when the clamshell (or similar) arrangement is dosed, reducing interference from stray light sources. Nonetheless, in preferred embodiments the light output from a pixel under test is modulated and hardware (or software) associated with the one or more detectors is configured to extract only signals with the same modulation. This helps reduce the effects of sunlight, room lights and other potential sources of interference. In a simple implementation a reference signal at a modulation frequency is used to modulate the driver, and also multiplies the sensed signal from a pixel prior to low pass filtering.

Embodiments of the invention are suitable for application in many types of electronic equipment including, but not limited to, laptop computers, DVD players, games consoles, PDAs, hand-held mobile communication and other devices, in particular mobile phones, as well as to devices with roll-up screens (when display (re)characterisation can be performed as the display is rolled-up and/or unrolled).

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A consumer electronic device (CED) having a display and a keyboard, and including at least one light sensor for recalibrating said display at intervals, wherein said display and said at least one light sensor are mounted within a unitary clamshell-type housing comprising first and second hingeably connected parts, said first hingeably connected part mounting said display, and said second hingeably connected part mounting at least a light sensing portion of said sensor and said keyboard, wherein at least the light sensing portion of said sensor is integrated with said keyboard so that said sensor is able to monitor light from said display when said clamshell-type housing is closed.

2. A CED as claimed in claim 1 wherein said light sensing portion of said sensor is disposed between keys of said keyboard.

3. A CED as claimed in claim 1 wherein a key of said keyboard is translucent and wherein said light sensing portion of said sensor is under said key.

4. A CED as claimed in claim 1, wherein said light sensor comprises a light emitting device configured for use in both a light sensing and a light emitting mode.

5. A CED as claimed in claim 1, wherein said light sensor comprises a light sensing device and a light guide to guide light from a light sensing portion of said sensor to said sensing device.

6. A CED as claimed in claim 1, comprising a plurality of said light sensors for sensing different parts of said display.

7. A CED as claimed in claim 6 further comprising a system to use said plurality of light sensors to sense a plurality of illuminated pixels of said display simultaneously.

8. A CED as claimed in claim 7 wherein said system comprises a data processor to multiply a vector having values defined by signals from said plurality of light sensors by a calibration matrix to determine light output data for said plurality of illuminated pixels.

* * * * *